US007280004B2

(12) United States Patent
Kroening

(10) Patent No.: US 7,280,004 B2
(45) Date of Patent: Oct. 9, 2007

(54) LATCHING FERRITE WAVEGUIDE CIRCULATOR WITHOUT E-PLANE AIR GAPS

(75) Inventor: Adam M. Kroening, Atlanta, GA (US)

(73) Assignee: EMS Technologies, Inc., Norcross, GA (US)

( * ) Notice: Subject to any disclaimer, the term of this patent is extended or adjusted under 35 U.S.C. 154(b) by 208 days.

(21) Appl. No.: 11/107,351

(22) Filed: Apr. 14, 2005

(65) Prior Publication Data

US 2006/0232353 A1 Oct. 19, 2006

(51) Int. Cl.
*H01P 1/39* (2006.01)

(52) U.S. Cl. ..... 333/1.1; 333/24.2

(58) Field of Classification Search ..... 333/1.1, 333/24.2

See application file for complete search history.

(56) References Cited

U.S. PATENT DOCUMENTS

| | | | |
|---|---|---|---|
| 3,221,255 | A | 11/1965 | Rabowsky et al. |
| 3,339,158 | A | 8/1967 | Passaro |
| 3,350,663 | A | 10/1967 | Siekanowicz et al. |
| 3,530,387 | A | 9/1970 | Bonfeld et al. |
| 3,582,831 | A | 6/1971 | Siekanowicz et al. |
| 3,710,280 | A | 1/1973 | Buck |
| 3,806,837 | A | 4/1974 | Carr et al. |
| 4,058,780 | A | 11/1977 | Riblet |
| 4,697,158 | A | 9/1987 | Hoover et al. |
| 5,266,909 | A | 11/1993 | Wolfert et al. |
| 5,608,361 | A | 3/1997 | Weiss et al. |
| 6,885,257 | B2 | 4/2005 | Kroening |

FOREIGN PATENT DOCUMENTS

| | | |
|---|---|---|
| DE | 34 41 352 A1 | 5/1986 |
| JP | 53135552 | 11/1978 |
| JP | 56 2301 | 2/1981 |
| JP | 2000 82901 | 3/2000 |
| JP | 2000332507 | 11/2000 |

*Primary Examiner*—Stephen E. Jones
(74) *Attorney, Agent, or Firm*—Hogan & Hartson LLP

(57) ABSTRACT

An apparatus, system, and method of and for a microwave circulator. The apparatus, system, and method includes a non-reciprocal element for coupling microwaves from an input port to at least one output port, wherein the non-reciprocal element is capable of isolating at least one of the at least one output port, and a plurality of fillers, wherein each of the plurality of fillers is corresponded to a portion of the non-reciprocal element, and wherein each of the plurality of fillers is substantially adjacent to the corresponded portion of the non-reciprocal element and at least substantially fills a span between the corresponded portion of the non-reciprocal element and a proximate conductor surface.

9 Claims, 9 Drawing Sheets

TOP VIEW

LATCHING FERRITE WAVEGUIDE CIRCULATOR WITHOUT E-PLANE AIR GAPS

FIELD OF THE INVENTION

The present invention relates to waveguide circulators, and more particularly to ferrite waveguide circulators without E-plane air gaps.

BACKGROUND OF THE INVENTION

Ferrite circulators have a wide variety of uses in commercial and military, space and terrestrial, and low and high power applications A waveguide circulator may be implemented in a variety of applications, including but not limited to low noise amplifier (LNA) redundancy switches, T/R modules, isolators for high power sources, and switch matrices. One important application for such waveguide circulators is in space, especially in satellites where extreme reliability is essential and where size and weight are very important. Ferrite circulators are desirable for these applications due to their high reliability, as there are no moving parts required. This is a significant advantage over mechanical switching devices. In most of the applications for waveguide switching and non-switching circulators, small size, low mass, and low insertion loss are significant qualities.

A commonly used type of waveguide circulator has three waveguide arms arranged at 120° and meeting in a common junction. This common junction is loaded with a non-reciprocal material such as ferrite. When a magnetizing field is created in this ferrite element, a gyromagnetic effect is created that can be used for switching the microwave signal from one waveguide arm to another. By reversing the direction of the magnetizing field, the direction of switching between the waveguide arms is reversed. Thus, a switching circulator is functionally equivalent to a fixed-bias circulator but has a selectable direction of circulation. Radio frequency (RF) energy can be routed with low insertion loss from one waveguide arm to either of the two output arms. If one of the waveguide arms is terminated in a matched load, then the circulator acts as an isolator, with high loss in one direction of propagation and low loss in the other direction.

Generally, these three-port waveguide switching circulators are impedance matched to an air-filled waveguide interface. For the purposes of this description, the terms "air-filled," "empty," "vacuum-filled," or "unloaded" may be used interchangeably to describe a waveguide structure. Conventional three-port waveguide switching circulators typically have one or more stages of quarter-wave dielectric transformer structures for purposes of impedance matching the ferrite element to the waveguide interface. The dielectric transformers are typically used to match the lower impedance of the ferrite element to the higher impedance of the air-filled waveguide so as to produce low loss.

Previous patents (U.S. Pat. No. 4,697,158; U.S. Pat. No. 3,277,399; U.S. Pat. No. 4,058,780, Pub. No. WO 02/067361 A1) have described approaches for achieving broad bandwidth through the additional of impedance matching elements. Broadband circulators have high isolation and return loss and low insertion loss over a wide frequency band, which is desirable so that the circulator is not the limiting component in the frequency bandwidth of a system. Broad bandwidth also allows a single design to be reused in different applications, thereby providing a cost savings. These prior art approaches for achieving broad bandwidth generally involve the additional of quarter-wave dielectric transformers or steps in the height or width of the waveguide structure to thus achieve impedance matching the ferrite element to the waveguide port. For example, U.S. Pat. No. 4,697,158 discloses achieving impedance matching by providing a step or transition in the waveguide pathway. This technique eliminates the standard dielectric transformers, but is very sensitive to dimensional variations, resulting in a design that is difficult and expensive to manufacture reliably. This design also relies on the presence of a significant gap or spacing between adjacent ferrite elements, increasing the size and weight of the structure. These methods all require impedance matching elements in addition to the ferrite element in order to achieve acceptable performance. Other patents, such as U.S. Pat. No. 5,724,010, discuss changing the shape of the ferrite resonant structure to achieve broadband performance. However, these ferrite structures are restricted to fixed-bias applications with a single direction of circulation.

Referring now to FIG. 1, there is shown a top view of a conventional ferrite element. Although magnetizing windings are not shown, dashed lines 135 denote the apertures for the magnetizing windings. Apertures 135 for the magnetizing windings may be created by boring a hole through each leg of the ferrite element, for example. If a magnetizing winding is inserted through the apertures, then a magnetizing field may be established in the ferrite element, as would be evident to those possessing an ordinary skill in the pertinent arts. The polarity of this field may be switched, alternately, by the application of current on the magnetizing winding to thereby create the switchable circulator.

Resonant section 130 exists where the legs of device 101 converge inside the three apertures 135. As would be evident to those possessing an ordinary skill in the pertinent arts, the dimensions of resonant section 130 determine the operating frequency for circulation in accordance with conventional design and theory. The sections 140 of the ferrite element in the area outside of the magnetizing winding apertures 135 may act as return paths for the bias fields in the resonant section 130 and as impedance transformers out of the resonant section. Faces 150 of the ferrite element are located at the outer edges of the three legs.

Referring now to FIG. 2, there is shown a top view of a conventional single-junction waveguide circulator structure. FIG. 2 shows a ferrite element 101 with a quarter-wave dielectric transformer 103 attached to each leg. A filler material 102 may be disposed on the top and bottom surfaces of ferrite element 101. Filler material 102 may be used to properly position the ferrite element in the housing and to provide a thermal path out of ferrite element 101, which may be necessary for high power applications. Conventional circulators have minimized the diameter of this spacer for impedance matching purposes, and the diameter is generally smaller than the size of resonant section 130 discussed hereinabove. An empirical matching element 104 may be disposed in close proximity to the quarter-wave dielectric transformers 103.

The conventional components described above may be disposed within the conductive waveguide structure 100, which is generally air-filled. For the purposes of this description, the terms "air-filled," "empty," "vacuum-filled," or "unloaded" may be used interchangeably to describe a waveguide structure. Conductive waveguide structure 100 may include waveguide input/output ports 105 as discussed above. Ports 105 may provide interfaces, such as for signal input and output, for example. Empirical matching elements 104 may be disposed on the surface of conductive waveguide structure 100 to affect the performance. Matching elements 104 may be capacitive/inductive dielectric or metallic buttons that are used to empirically improve the impedance match over the desired operating frequency band.

Referring now to FIG. 3, there is shown a partial side view of a conventional single-junction waveguide circulator structure. As may be seen in FIG. 3, only one of the three legs of the ferrite element is shown. This view shows filler materials 102 located between the walls of waveguide structure 100 and ferrite element 101. As a result of filler materials 102 being smaller in diameter than the legs of ferrite element 101, air gaps 110 exist above and below portions of the legs of the ferrite element. Air gaps 110 may be approximately one-third the height of the waveguide in the E-plane axis. Air gaps 110 in the E-plane may be prone to high peak power breakdown effects such as arcing or multipactor, as would be evident to those possessing an ordinary skill in the pertinent arts. Thus, air gaps 110 may limit the maximum peak power handling capabilities of conventional circulator designs.

Accordingly, a need exits for a device that improves peak power handling, heat dissipation, and other characteristics, in part by elimination of a gap adjacent to the conductive portion of a waveguide.

SUMMARY OF THE INVENTION

A microwave circulator is discussed, including a non-reciprocal element for coupling microwaves from an input port to at least one output port, wherein the non-reciprocal element is capable of isolating at least one of the at least one output port; and a plurality of fillers. Each of the plurality of fillers may be corresponded to a portion of the non-reciprocal element, and each of the plurality of fillers may be substantially adjacent to the corresponded portion of the non-reciprocal element and may at least substantially fill a span between the corresponded portion of the non-reciprocal element and a proximate conductor surface.

Also discussed is a system for circulating microwaves in a waveguide, including a waveguide that includes three ports, a ferrite element that substantially exclusively couples microwaves from a first of the three ports to another of the three ports, wherein the substantially exclusive coupling is responsive to an activation of at least one magnetizable winding associated with the ferrite element, and a plurality of fillers, wherein each of the plurality of fillers substantially fills each span between the ferrite element and proximate opposing walls of the waveguide.

Additionally discussed is a method of circulating microwaves in a waveguide, including magnetizing at least one of a plurality of magnetizable windings to energize a ferrite element to circulate microwaves from an input port of the waveguide to one selected from two output ports of the waveguide, and substantially filling a span between the ferrite element and a proximate one of opposing walls of the waveguide with at least one filler.

The apparatus, system, and method of the present invention provide a device that improves peak power handling, heat dissipation, and other characteristics, in part by elimination of a gap adjacent to the conductive portion of a waveguide.

BRIEF DESCRIPTION OF THE FIGURES

Understanding of the present invention will be facilitated by consideration of the following detailed description of the present invention taken in conjunction with the accompanying drawings, in which like numerals refer to like parts, and wherein.

DETAILED DESCRIPTION OF THE INVENTION

Figure 1:
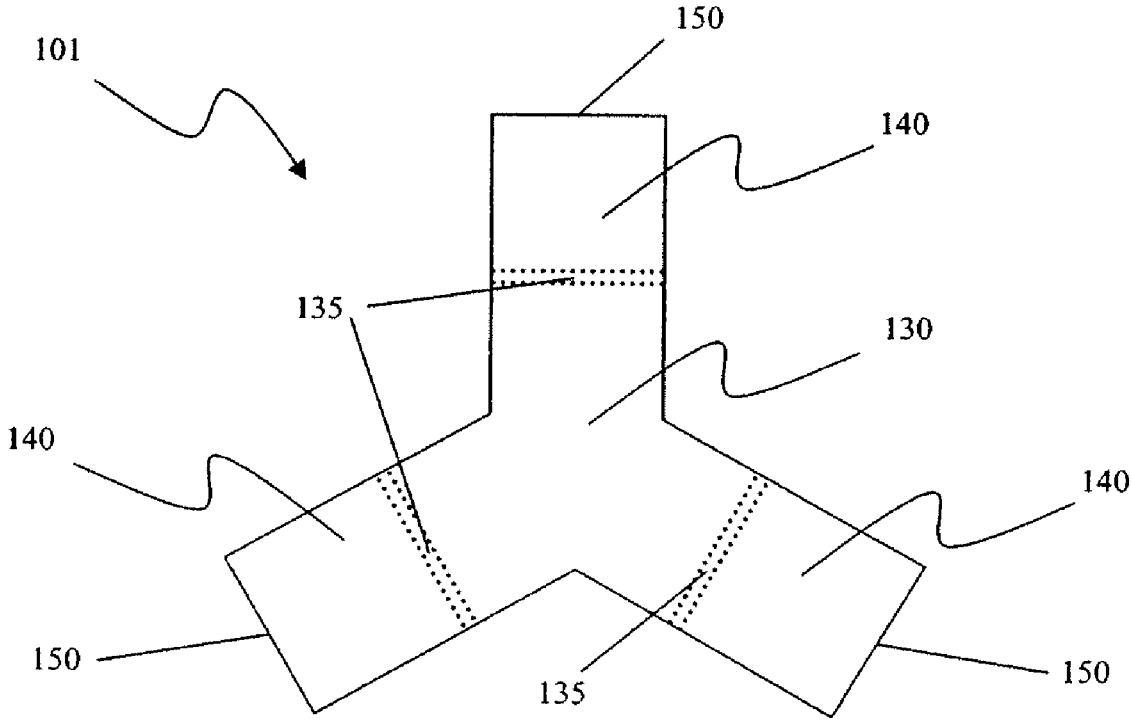
Figure 1 (Prior Art)
FIG. 1 shows a top view of a conventional ferrite element.
Figure 2:
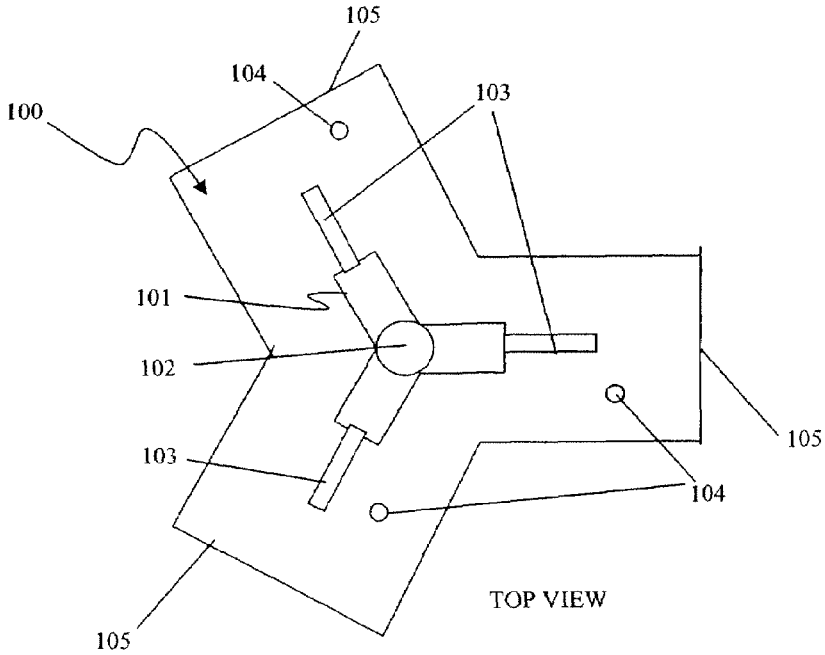
Figure 2 (Prior Art)
FIG. 2 shows a top view of a conventional single-junction waveguide circulator structure.

It is to be understood that the figures and descriptions of the present invention have been simplified to illustrate elements that are relevant for a clear understanding of the present invention, while eliminating, for the purpose of clarity, many other elements found in typical waveguide applications, and systems and methods of using the same. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein. The disclosure herein is directed to all such variations and modifications to such elements and methods known to those skilled in the art.

The present invention improves upon conventional waveguide circulators by modifying the geometry of a non-reciprocal circulator in order to increase the peak power handling in terms of breakdown phenomena, such as arcing and multipactor, for example. The improved geometry results from eliminating the air gaps between the non-reciprocal, generally ferrite, elements and the waveguide broadwalls in the high voltage E-plane direction. The gaps may be eliminated by completely filling the span of the gap with modified versions of the parts already present in the conventional waveguide circulator structure, such as dielectric spacers or quarter-wave dielectric transformers, or with additional filler elements. Filler materials suitable for use in the present invention include, but are not limited to, such materials as teflon, alumina and forsterite.

In addition to improved peak power handling, the present invention improves average power handling. By filling the air gap with a thermally conductive material, such as beryllium oxide or boron nitride, for example, the thermal resistance from the ferrite element to the conductive waveguide structure may be reduced by the increased contact area between the ferrite element and the filler material. The net effect may be a reduction in the temperature rise of the ferrite element, which may lead to improved thermal stability and improved microwave performance. There may be RF switching applications wherein alternate switch technologies, such as pin diode or mechanical switches, are used because of their power handling capabilities, and the present invention may broaden the applications for ferrite switches to such embodiments, thus providing a viable alternative to other switch technologies in high peak and average power applications.

The microwave circulator discussed may be a nonreciprocal ferrite device containing three ports. A three-port ferrite junction circulator, referred to as a "Y" junction circulator, may be commonly used and may be available in rectangular waveguide. Generally, the signal flow in a three-port circulator is 1→2, 2→3, and 3→1.

For example, if port 1 is the input port, the signal may exit from port 2 and, in an ideal configuration, no signal should result on port 3, often referred to as the isolated port. In such a configuration, the loss from port 1 to 2 is referred to as the insertion loss, and the loss from port 1 to 3 is referred to as isolation. Generally, a circulator may have a few tenths of a dB insertion loss and typically 20 dB isolation.

If one port of a circulator is loaded, that circulator may become an isolator. Power may pass from ports 1 to 2, but power reflected back from port 2 may go to the load at port 3 instead of retracing back to port 1.

Figure 4:
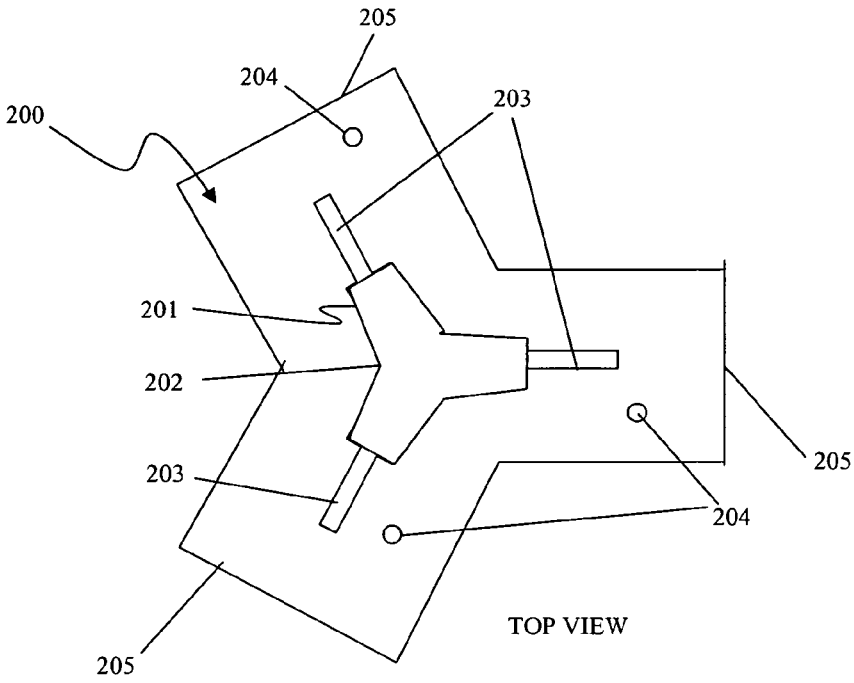
FIG. 4 shows a top view of a waveguide circulator structure incorporating a dielectric spacer to fill the gaps above and below the ferrite element according to an aspect of the present invention.

Referring now to FIG. 4, there is shown a top view of a device according to an aspect of the present invention. Filler materials 202 may be disposed on the top and bottom surfaces of a non-reciprocal, such as a ferrite, element 201 (not shown). Top filler material 202 may have an area that completely covers the ferrite element so that there are no air gaps between the ferrite element and the conductive waveguide structure, such as in the critical axis perpendicular to the page in the figure. While the present discussion contemplates and describes the present invention as completely covering the ferrite structure in the E-plane, there is no reason that benefits commensurate with those discussed in the exemplary embodiments herein could not be obtained from a substantially complete covering. Further, As discussed herein a complete covering or fill contemplates that air bubbles and other impurities may exist and while technically this would render the covering less than complete, the present use of the terminology completely filled incorporates such impurities and includes therein substantial complete filling as well. As such, the present discussion should be understood to include substantially complete covering, as well as complete covering.

The E-plane direction may be critical because of the orientation of the electric field and the high voltages in the structure. Although filler materials 202 are shown in the figures as having a "Y" shape to the ferrite element 201, any geometry may be used for the filler materials 202, provided that the area shown in the top view completely covers the area of the ferrite element 201 through the E-plane.

Additional elements of the device may electrically contact and effect the waveguide or the ferrite element therein. In an exemplary embodiment, a quarter-wave dielectric transformer 203 may be attached to each leg of ferrite element 201 and filler material 202 assembly. Further, an empirical matching element 204 may be disposed in close proximity to quarter-wave dielectric transformers 203. All of the components described above may be disposed completely, partially or substantially within conductive waveguide structure 200.

The conductive waveguide structure may be air-filled. Conductive waveguide structure 200 may also include waveguide input/output ports 205. Waveguide ports 205 may provide interfaces for signal input and output. The empirical matching elements 204 may be disposed on the surface of conductive waveguide structure 200 to affect the performance characteristics. Matching elements may be capacitive/inductive dielectric or metallic buttons used to empirically improve the impedance match over the desired operating frequency band.

Figure 5:
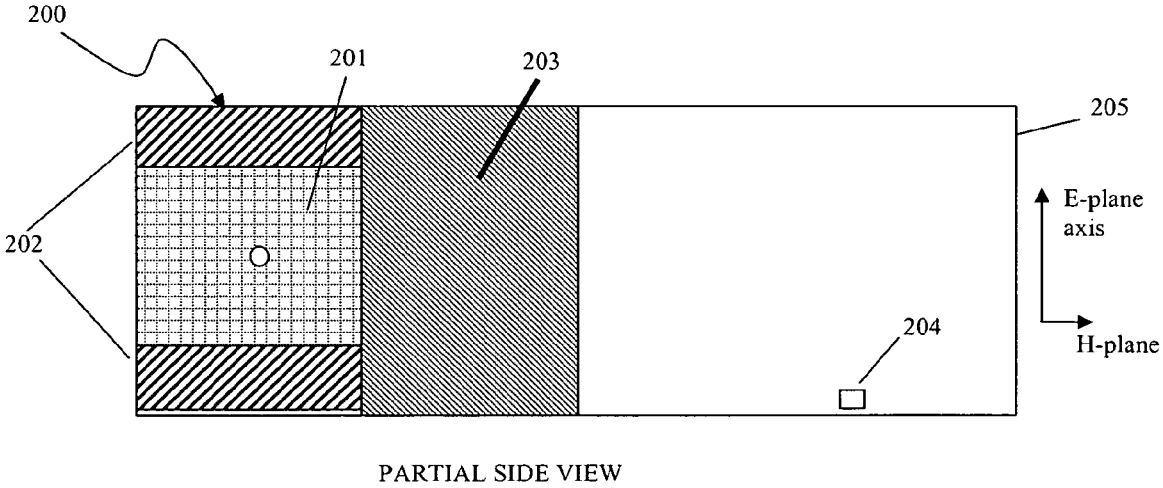
FIG. 5 shows a partial side view of the structure shown in FIG. 4.

Referring now also to FIG. 5, there is shown a side view of the circulator of FIG. 4. In this view, only one of the three legs of the ferrite element is shown. As shown in FIG. 5, filler materials 202 are extended to substantially fill the span between the walls of waveguide structure 200 and ferrite element 201, thereby eliminating air gaps 110 previously shown in the conventional circulator of FIG. 3. Similarly, filler material 202 might be provided as an element separate from the dielectric filler used to eliminate the span, as illustrated in the next embodiment.

Figure 6:
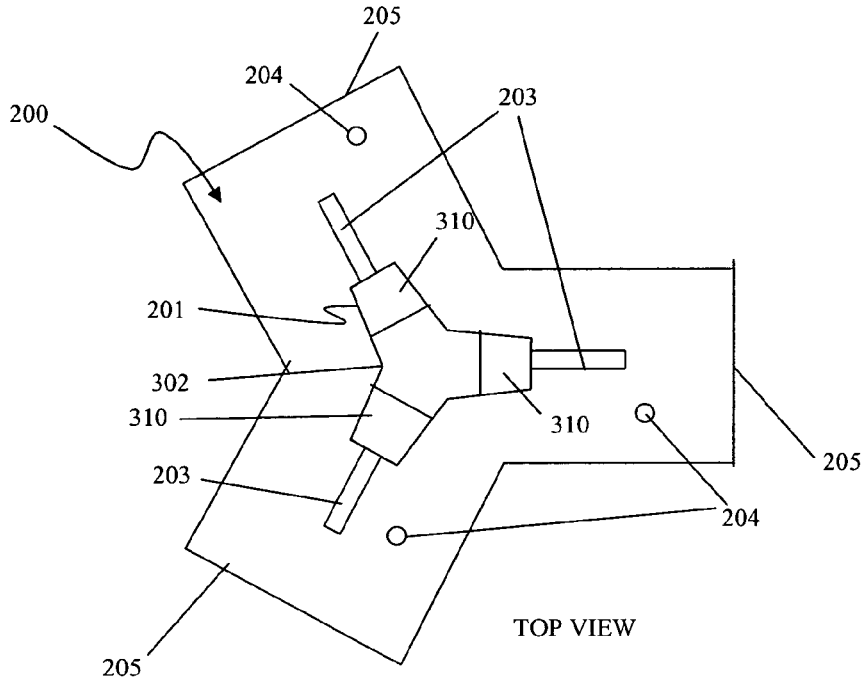
FIG. 6 shows a top view of a waveguide circulator structure incorporating multiple dielectric spacers to fill the gaps above and below the ferrite element according to an aspect of the present invention.
Figure 15:
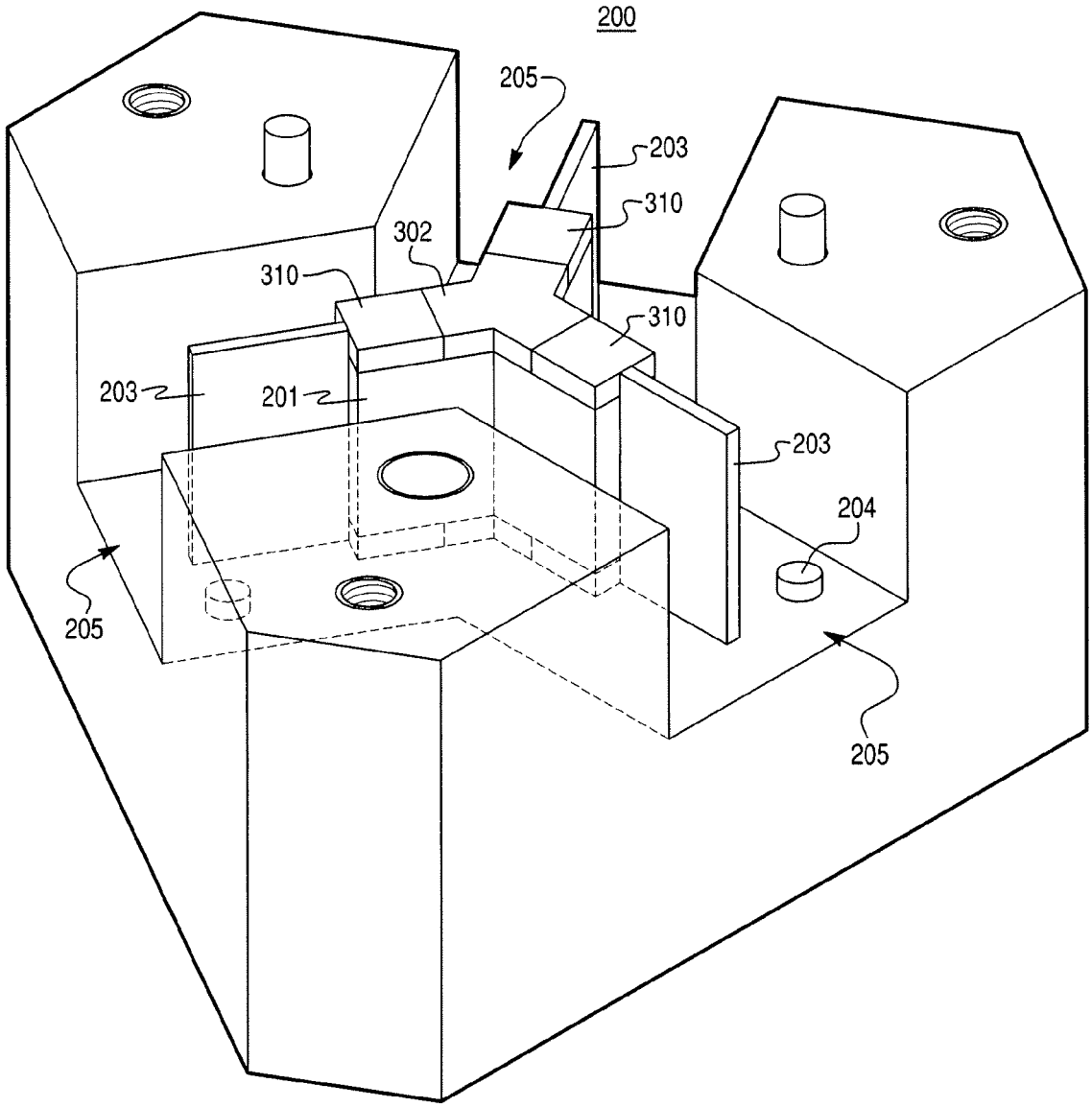
FIG. 15 shows an isometric view of the waveguide circulator structure of FIGS. 6 and 7.

Referring now to FIGS. 6 and 15, there is shown a top view (FIG. 6) and an isometric view (FIG. 15) of an embodiment of a device according to an aspect of the present invention. As may be seen in FIGS. 6 and 15, filler materials 302 and 310 may be disposed on the top and bottom surfaces of ferrite element 201 (not shown in FIG. 6). The materials selected for filler materials 302 and 310 may be chosen independently in terms of microwave and thermal properties to allow for more flexibility in the impedance matching of the circulator. The combination of the top filler materials 302 and 310 may provide an area that completely covers ferrite element 201, thereby eliminating air gaps between ferrite element 201 and conductive waveguide structure 200, such as in the critical axis running into/out of the page, for example. Although filler materials 302 and 310 are shown in the figures as having a similar "Y" shape to the ferrite element 201, any geometry may be used for the filler materials 302 and 310 provided that the area shown in the top view completely covers the area of the ferrite element 201. As described hereinabove, quarter-wave dielectric transformers 203, empirical matching elements 204, and conductive waveguide structure 200, may also be used in this aspect of the present invention as well.

Figure 3:
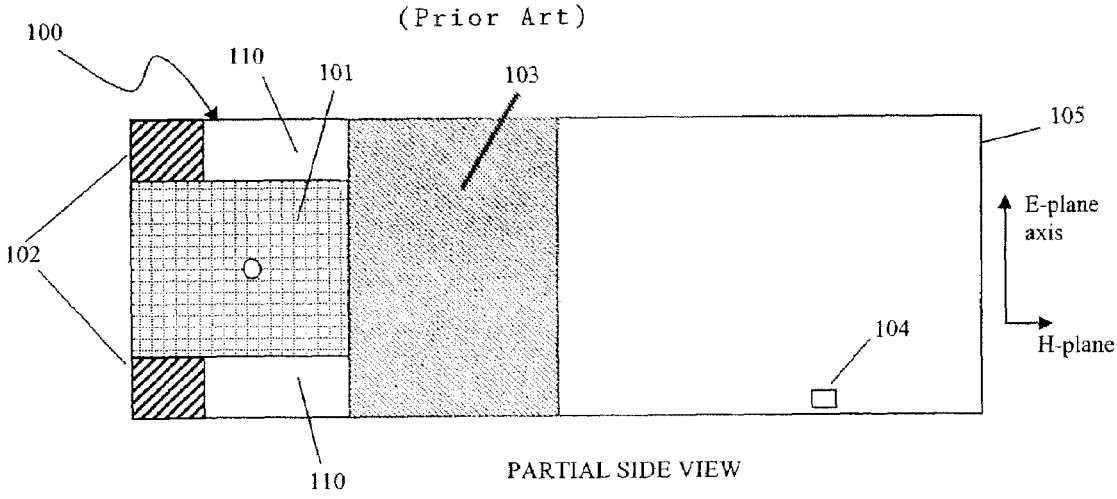
Figure 3 (Prior Art)
FIG. 3 shows a partial side view of a conventional single-junction waveguide circulator structure.
Figure 7:
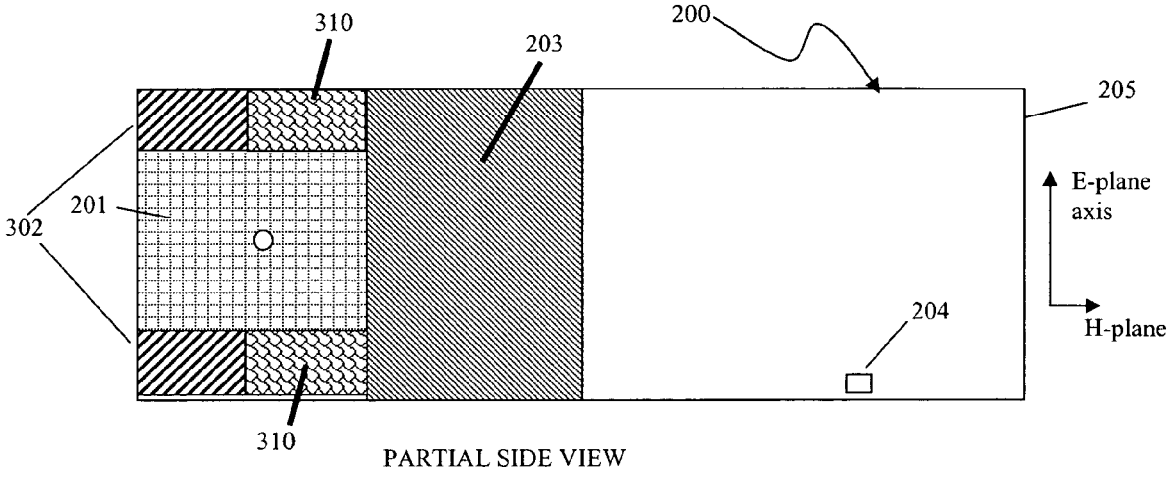
FIG. 7 shows a partial side view of the structure shown in FIG. 6.

Referring now also to FIG. 7, there is shown a side view of the circulator of FIG. 6. As may be seen in FIG. 7, one of the three legs of the ferrite element is shown. FIG. 7 illustrates that filler materials 302 and 310 may substantially or completely fill the span between the walls of waveguide structure 200 and ferrite element 201, thereby eliminating the air gaps 110 of conventional circulators as depicted in FIG. 3.

Figure 8:
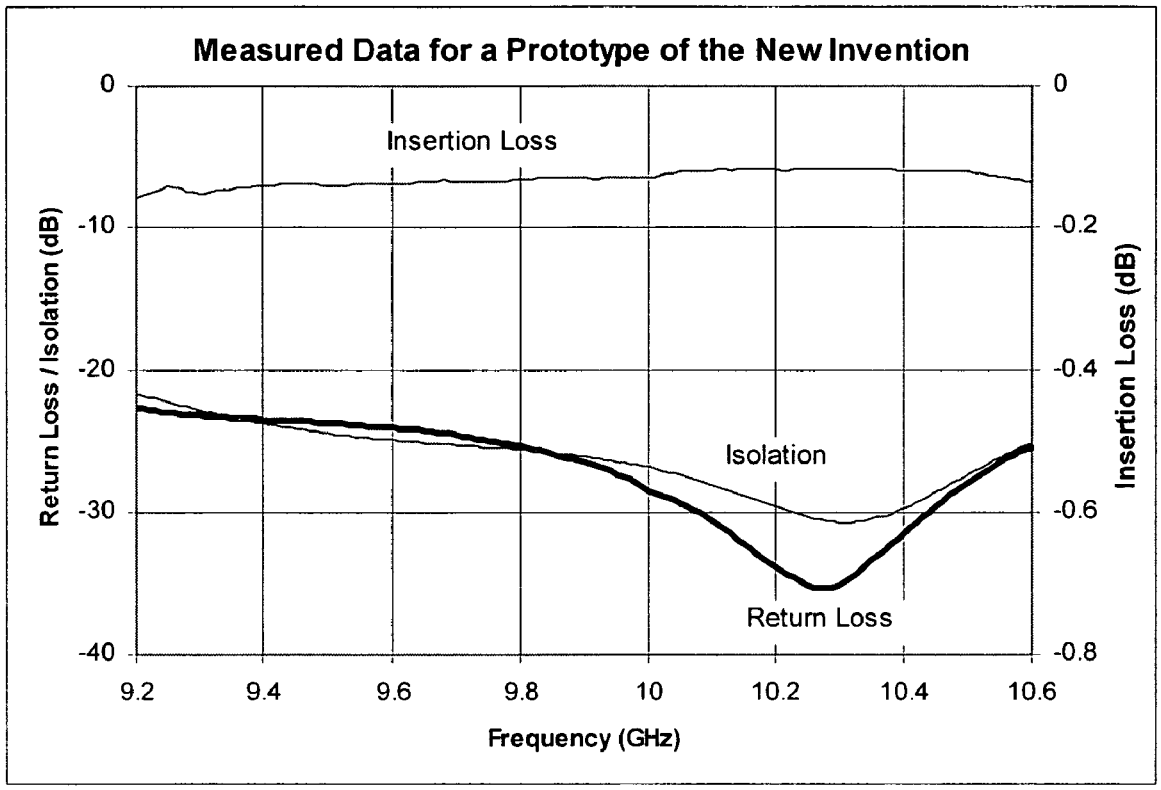
FIG. 8 shows measured microwave data for a device depicted in FIG. 6.

Referring now to FIG. 8, there is shown data representing the measured insertion loss, isolation, and return loss data from a prototype of the device depicted in FIG. 6. As may be seen in FIG. 8, and as may be realized by those possessing an ordinary skill in the pertinent arts, this data is comparable in low power performance to conventional designs, but is improved in the high peak power levels due to the presence of the filler material, thus allowing the present invention to handle twice as much power as conventional circulators in terms of multipactor breakdown at high peak power levels.

Figure 9:
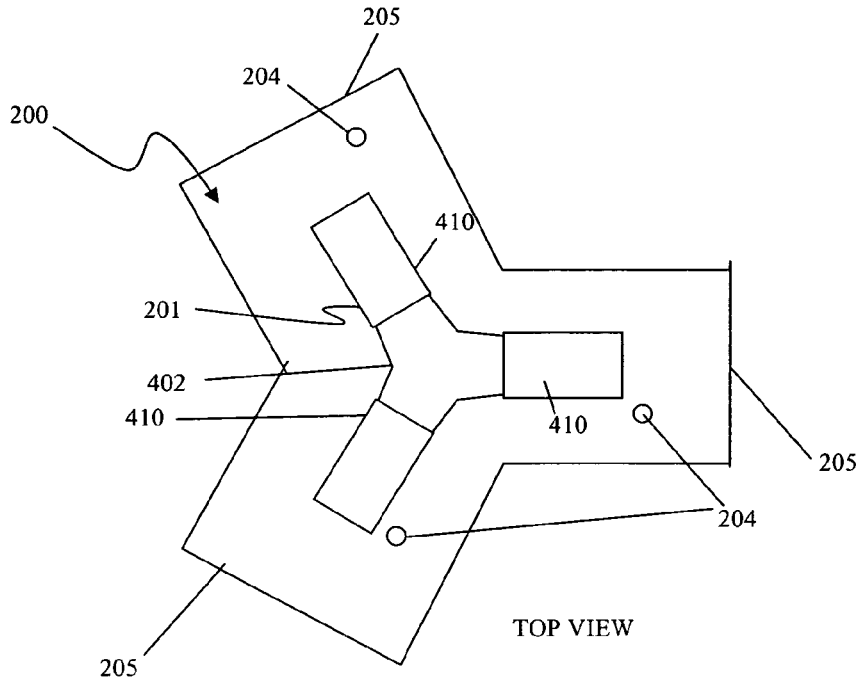
FIG. 9 shows a top view of a third embodiment of a single-junction waveguide circulator structure wherein multiple dielectric spacers are used to fill the gaps above and below the ferrite element and the full-height quarter-wave dielectric transformers are formed as an extension of the dielectric spacers.

Referring now to FIG. 9, there is shown a top view of a device according to an aspect of the present invention. Filler materials 402 and 410 may be disposed on the top and bottom surfaces of ferrite element 201 (not shown). The filler materials selected for filler materials 402 and 410 may be chosen independently in terms of microwave and thermal properties to allow for more flexibility in the impedance matching of the circulator. The combination of the top filler materials 402 and 410 has an area that completely covers ferrite element 201 to substantially eliminate air gaps between ferrite element 201 and conductive waveguide structure 200, such as in the critical axis running into/out of the page, for example. Although filler materials 402 and 410 have been illustrated to have a similar "Y" shape to ferrite element 201, any geometry may be used for filler materials 402 and 410. Filler materials 410 extend beyond the end of the legs of the ferrite element 201, filling the full height in the E-place direction of the conductive waveguide structure, so that they serve the function of a traditional quarter-wave dielectric transformer in addition to filling the air gap between the ferrite element 201 and the conductive waveguide structure 200.

Figure 10:
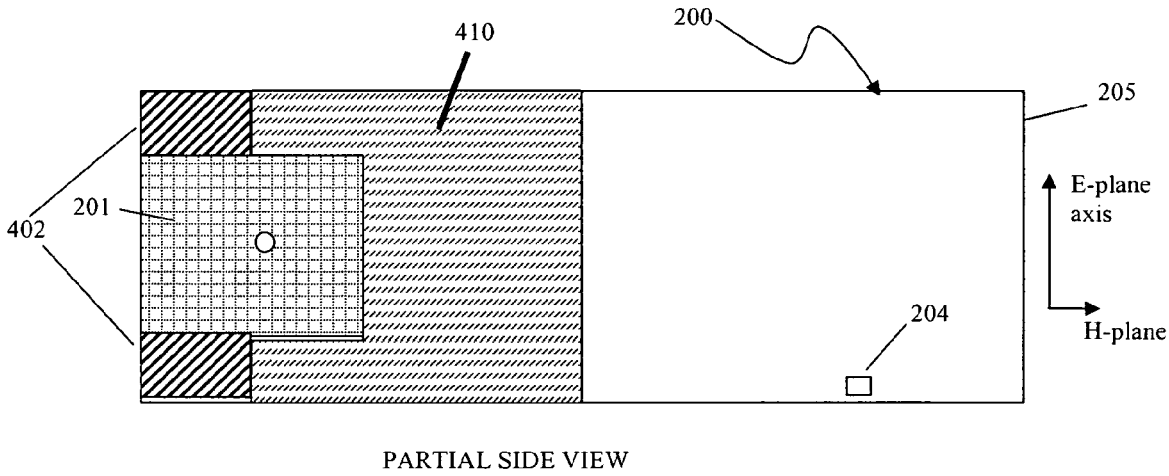
FIG. 10 shows a partial side view of the embodiment of FIG. 9.

Referring now to FIG. 10, there is shown a side view of the circulator of FIG. 9. In this view, only one of the three legs of the ferrite element is shown. As may be seen in FIG. 10, filler materials 402 and 410 completely fill the span between the walls of waveguide structure 200 and ferrite element 201, thereby substantially eliminating the air gaps 110 present in the prior art illustrated in FIG. 3.

Figure 11:
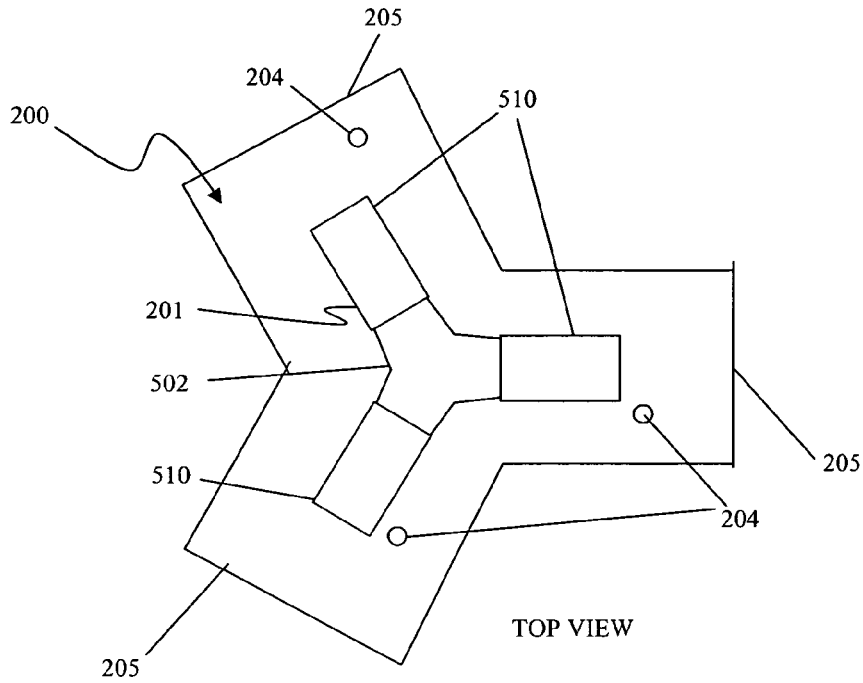
FIG. 11 shows a top view of a fourth embodiment of a single-junction waveguide circulator structure wherein multiple dielectric spacers are used to fill the gaps above and below the ferrite element and the traditional full-height quarter-wave dielectric transformers are replaced with an alternate geometry of quarter-wave dielectric transformers formed as an extension of the dielectric spacers.

Referring now to FIG. 11, there is shown a top view of a device according to an aspect of the present invention. As may be seen in FIG. 11, filler materials 502 and 510 may be disposed on the top and bottom surfaces of ferrite element 201 (not shown). The filler materials selected for filler materials 502 and 510 may be chosen independently in terms of microwave and thermal properties to allow for more flexibility in the impedance matching of the circulator. The combination of the top filler materials 502 and 510 may provide an area that completely covers ferrite element 201 to substantially eliminate air gaps between ferrite element 201 and conductive waveguide structure 200. Filler materials 510 may extend beyond the end of the legs of ferrite element 201, but spacers 510 do not necessarily fill the full height in the E-place direction of the conductive waveguide structure. Although filler materials 510 may appear physically different from the quarter-wave dielectric transformers of conventional circulators, such elements may serve the same function as a traditional quarter-wave dielectric transformer in addition to filling the air gap between ferrite element 201 and conductive waveguide structure 200. The previous descriptions of empirical matching elements 204 and conductive waveguide structure 200 may apply to the present embodiment as well.

Figure 12:
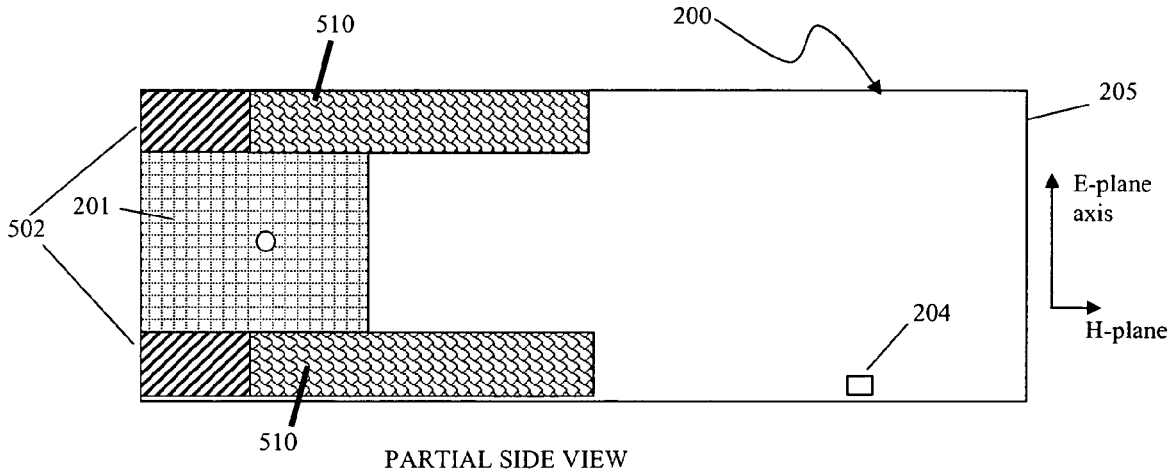
FIG. 12 shows a partial side view of the embodiment of FIG. 11.

Referring now also to FIG. 12, there is shown a side view of the circulator of FIG. 11. In this view, only one of the three legs of the ferrite element is shown. As may be seen in FIG. 12, filler materials 502 and 510 may substantially or completely fill the region between the walls of waveguide structure 200 and ferrite element 201, thereby eliminating air gaps 110 previously discussed.

Figure 13:
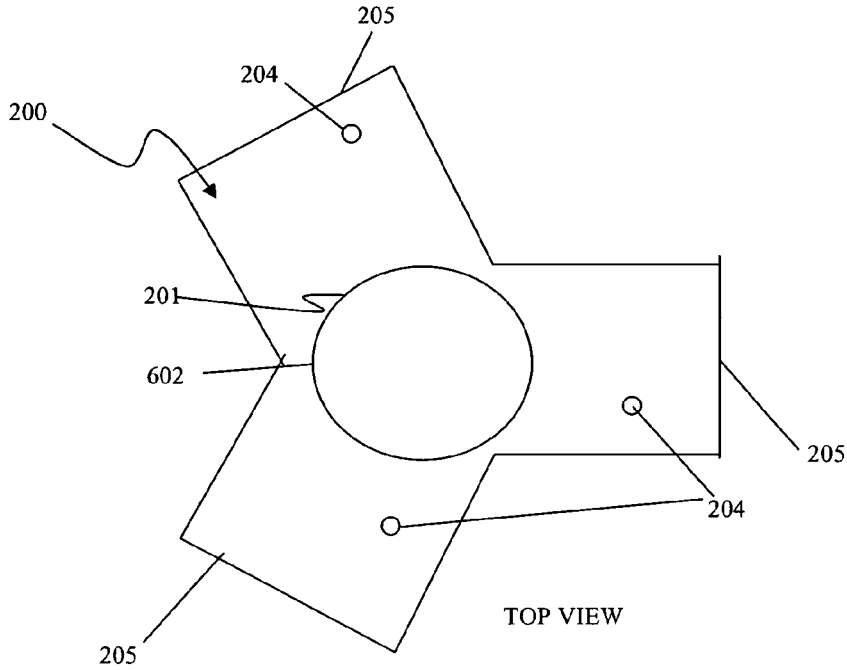
FIG. 13 shows a top view of a first embodiment of a single-junction waveguide circulator structure wherein a one-piece filler material is used to fill the gaps above and below the ferrite element and the quarter-wave dielectric transformers associated with traditional designs are not required for impedance matching purposes; and, FIG. 14 shows a partial side view of the embodiment of FIG. 13.

Referring now to FIG. 13, there is shown a top view of a device according to an aspect of the present invention. As may be seen in FIG. 13, filler materials 602 may be disposed on the top and bottom surfaces of ferrite element 201 (not shown). Top filler material 602 may have an area that completely covers ferrite element 201 to reduce air gaps between ferrite element 201 and conductive waveguide structure in the axis running into/out of the page. Although filler materials 602 are illustrated to have the same cylindrical shape as in the prior art, any geometry can be used for the filler materials 602 provided that the area shown in the top view completely covers the area of ferrite element 201. In the present embodiment, it is not necessary to have quarter-wave dielectric transformers for impedance matching purposes, although such dielectrics may be used. Impedance matching may be implemented through the selected materials and dimensions of ferrite element 201 and filler materials 602. Matching elements 204 may be disposed within conductive waveguide structure 200 for empirical improvements to the impedance matching. The earlier discussions of empirical matching elements 204 and conductive waveguide structure 200 may apply to the present embodiment.

Figure 14:
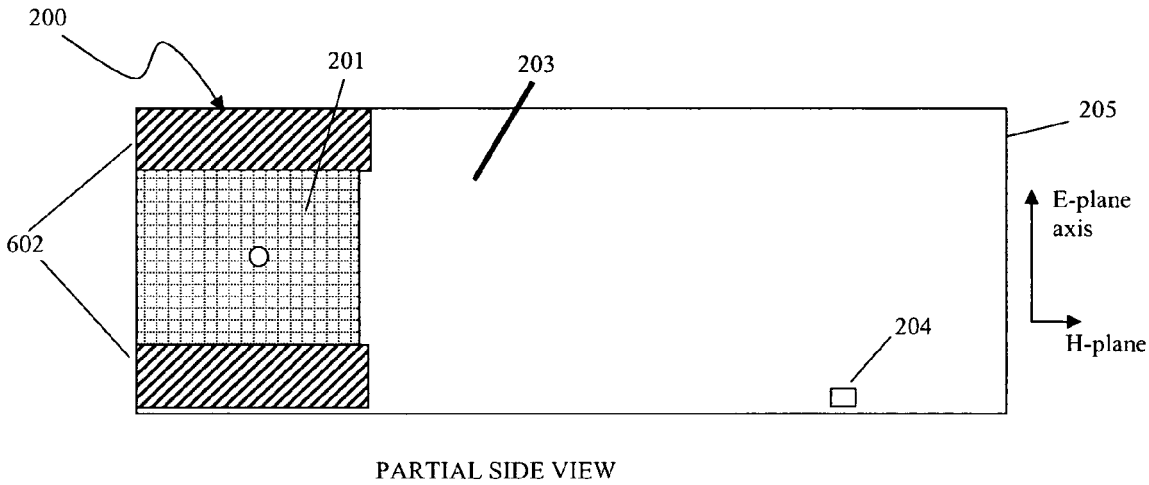

Referring now also to FIG. 14, there is shown a side view of the circulator of FIG. 13. As is evident in FIG. 14, only one of the three legs of the ferrite element is shown. This side view shows that filler materials 602 completely fill the region between the walls of waveguide structure 200 and ferrite element 201 to reduce air gaps 110 as discussed herein throughout.

Those of ordinary skill in the art may recognize that many modifications and variations of the present invention may be implemented without departing from the spirit or scope of the invention. Thus, it is intended that the present invention covers the modifications and variations of this invention provided they come within the scope of the appended claims and their equivalents.

What is claimed is:

1. A system for circulating microwaves in a waveguide, comprising:

a waveguide, wherein said waveguide includes three ports;

a ferrite element that substantially exclusively couples microwaves from a first of said three ports to another of said three ports, wherein the substantially exclusive coupling is responsive to an activation of at least one magnetizable winding associated with said ferrite element; and a plurality of fillers, wherein each of said plurality of fillers completely fills each span between said ferrite element and proximate opposing walls of said waveguide.

2. The system of claim 1, wherein said plurality of fillers comprise at least one selected from dielectric spacers and quarter-wave dielectric transformers.

3. The system of claim 1, wherein each of plurality of fillers conforms to the ferrite element.

4. The system of claim 1, wherein the ferrite element is braced with at least one dielectric spacer separate from the dielectric filler.

5. The system of claim 1, wherein each of plurality of fillers substantially fills in an E-plane.

6. The system of claim 1, wherein the at least three ports comprise waveguide arms arranged at 120 degrees that meet at a unified junction.

7. The system of claim 6, wherein said ferrite element has a resonant portion at the unified junction.

8. The system of claim 1, further comprising empirical impedance matching elements disposed on a conductive portion of said waveguide.

9. The system of claim 8, wherein said impedance matching elements are capacitive dielectrics.

* * * * *